United States Patent [19]

Stirrat et al.

[11] Patent Number: 4,548,490

[45] Date of Patent: Oct. 22, 1985

[54] TONER FEEDER SYSTEM

[75] Inventors: John C. Stirrat, West Hill; Kenneth L. Hurley, Unionville; Brian F. Whittaker, Toronto, all of Canada

[73] Assignee: Delphax Systems, Mississauga, Canada

[21] Appl. No.: 523,918

[22] Filed: Aug. 16, 1983

[30] Foreign Application Priority Data

Aug. 24, 1982 [CA] Canada ..... 409997

[51] Int. Cl.[4] ..... G03G 15/08

[52] U.S. Cl. ..... 355/3 DD; 355/14 D

[58] Field of Search ..... 355/3 DD, 14 D; 118/652, 647, 651, 658; 430/122

[56] References Cited

U.S. PATENT DOCUMENTS

| | | | |
|---|---|---|---|
| 4,194,830 | 3/1980 | Ohnuma et al. | 355/3 DD |
| 4,233,935 | 11/1980 | Uehara et al. | 355/3 DD X |
| 4,267,796 | 5/1981 | Kamogawa et al. | 355/3 DD X |
| 4,337,724 | 7/1982 | Hosono et al. | 355/3 DD X |
| 4,466,730 | 8/1984 | Jugle | 355/3 DD |

*Primary Examiner*—A. C. Prescott

*Attorney, Agent, or Firm*—Hirons, Rogers & Scott

[57] ABSTRACT

A toner feeder is provided for use with a magnetic roller to tone electrostatic images. The feeder includes a doctor blade attached to an adjustable block for varying the gap between an edge of the blade and the magnetic roller. The block and blade combine to define a recess above the blade and toner builds up in the recess to present a living wall of toner. This reduces agglomeration and build up of toner lumps. The invention is particularly useful with toners requiring relatively low fusing pressures.

5 Claims, 3 Drawing Figures

TONER FEEDER SYSTEM

This invention relates to apparatus for use in printing and copying and more particularly to a toner feeder used in an applicator which feeds toner from a hopper onto latent electrostatic images carried on the surface of a dielectric cylinder or photoreceptor medium to tone these images prior to transfer onto a receptor such as a paper sheet.

Electrostatic printers and copiers generally use a single component magnetic toner powder which is both fine and dense. The powder is fed under gravity from a hopper onto a magnetic roller which carries a controlled layer of toner onto an electrostatic image carried by a cylinder forming part of either a printer or a copier. The toner must meet two diametrically opposed design criteria. Firstly, in order to fuse the toner into a receptor such as paper, it is desirable that the toner fuse to the paper under low pressure to minimize the pressures needed for pressure fusing. Secondly, toners which meet the first criterion tend to consolidate under gravity to exclude air. Further as the toner is agitated and moved towards the magnetic roller, individual particles of toner impact with other particles and if their force is sufficiently high, then the toner particles will agglomerate into undesirable larger particles and even lumps. Consequently this second design criterion suggests that the toner should be capable of resisting impacts between individual particles. As a result, if the first criterion is to be met, the problems of toner agglomeration and impact build-up must be overcome when using toners requiring lower fusing pressures.

The present invention is intended to provide a toner feed system or applicator capable of use with toners used in pressure fusing systems.

It has also been found that when the toner is moving towards a doctor blade at the exit from the toner feed system, the toner particles impact on the blade and associated parts thereby tending to cause a build-up of toner. As a result, the flow of toner can be interrupted locally, resulting in smears, or more likely, areas where no toner passes onto the magnetic roller resulting in uneven distribution of toner on the dielectric or photoreceptor surfaces. Various forms of doctor blade and associated structure have been considered but none overcome such difficulties fully.

Unexpectedly, applicant has found that by removing solid controlling surfaces from the vicinity of the doctor blade, and by allowing the toner to build up above this blade, the toner itself develops a control surface which in association with the doctor blade permits the flow of toner onto the magnetic roller while minimizing impact and consequent build-up difficulties. This control surface will be termed a "living wall" in this description and in the associated claims.

The invention will be better understood with reference to the following description taken in combination with the drawings in which.

Figure 1:
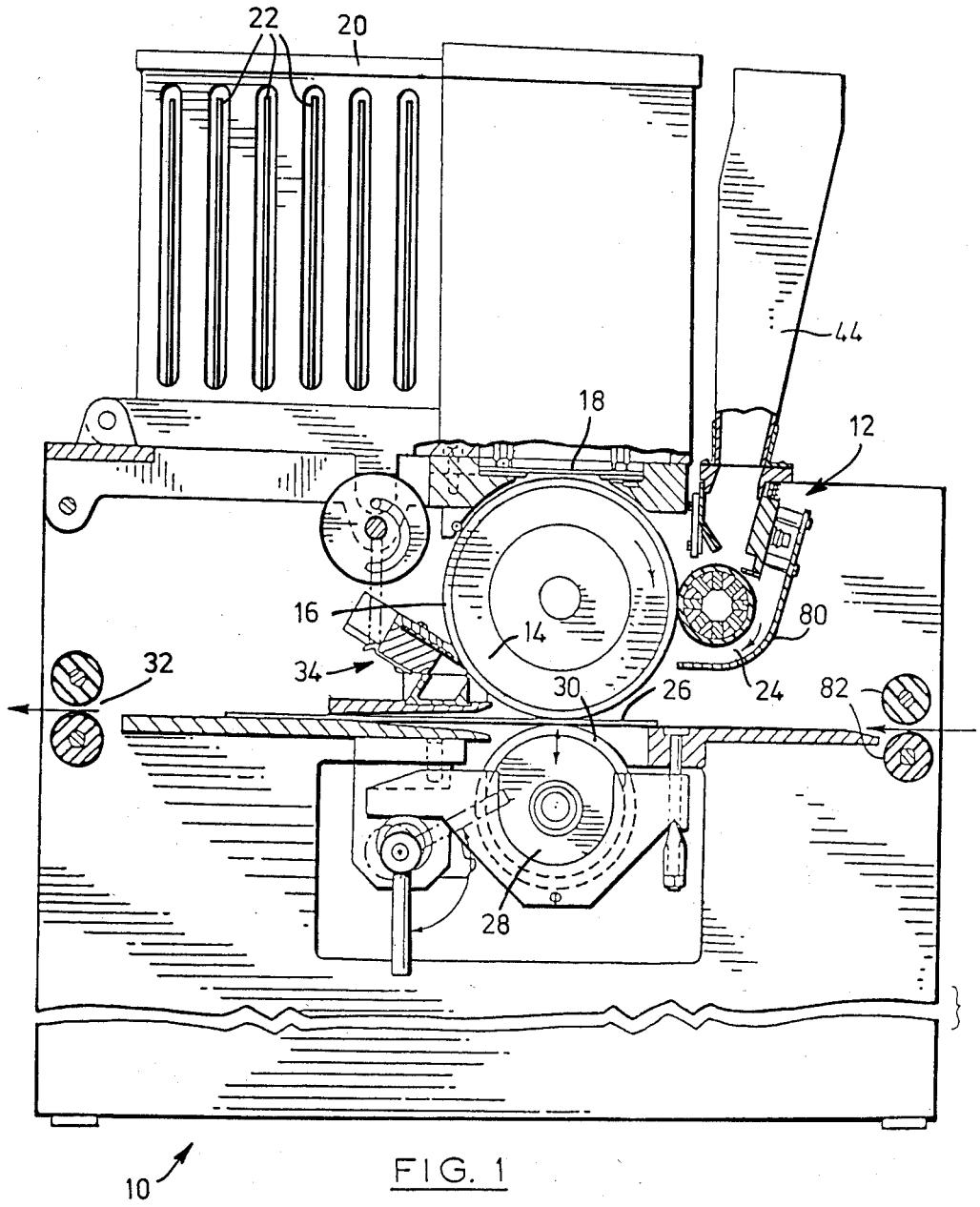
FIG. 1 is a side view, partially sectioned and broken away, and illustrating a typical printer structure using a toner feeder system according to a preferred embodiment of the invention.

As seen in FIG. 1, an exemplary electrostatic printing apparatus 10 is shown incorporating a toner feeder system 12 according to a preferred embodiment of the invention. The electrostatic printing apparatus consists essentially of a cylinder 14 having a dielectric layer 16 for receiving an electrostatic image formed by a cartidge 18 controlled by an electrical input system 20 having circuit boards 22. The input system 20 creates in combination with the cartridge 18 an electrostatic image on the surface of the dielectric layer 16 and as the cylinder 14 turns, this image is brought into alignment with a magnetic roller 24 which carries toner from the toner feeder system 12 to the cylinder 14. The roller 24 is made to rotate in the same direction as the cylinder 14 so that the adjacent peripheries of these parts are moving in opposite directions. Toner carried by the magnetic roller 24 brushes the surface of the dielectric layer 16 so that toner particles are attracted to the electrostatic image on this layer to thereby "tone" the image. This toned image is carried by the cylinder 14 to the lowermost point (as drawn) where it meets a receptor 26 (such as a paper sheet) at a nip formed in conjunction with a pressure roller 28. This roller has a compliant layer 30 so that the pressure created at the nip causes the toned image on the dielectric layer 16 to be transferred onto the receptor 26 and at the same time fused due to the pressure in the nip. The paper passes on through the nip before leaving between a pair of exit rollers 32. The portion of the dielectric layer 16 carrying the image then passes a scraper blade assembly 34 to remove any excess toner before meeting the cartridge 18 which at its leading edge has an erase unit to neutralize any electrostatic charge remaining on the dielectric layer 16 prior to placing a new electrostatic image on the layer. Other parts shown in FIG. 1 are included to give an indication of the actual form of such an electrostatic printer but have no direct bearing on the present invention which is directed to the toner feeder system which will now be described in more detail.

Figure 2:
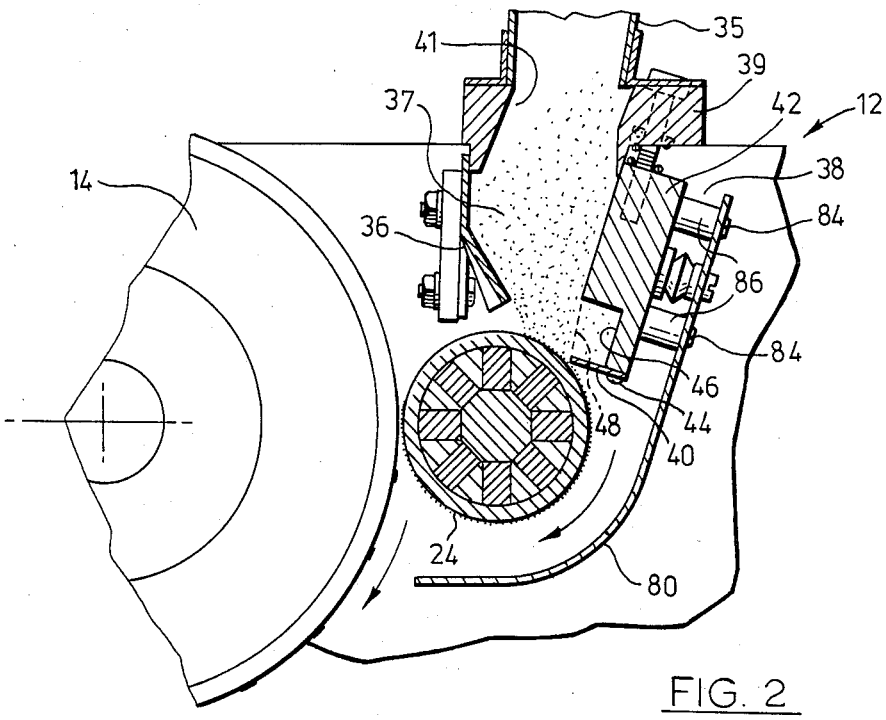
FIG. 2 is a view similar to FIG. 1 but showing the toner feeder system and magnetic roller to a larger scale.

As better seen in FIG. 2, the toner feeder system 12 receives toner from a hopper 35 through which toner powder 37 is fed. The hopper stands on a support 39 having an opening 41 aligned with the hopper. The support also carries a retaining plate 36 and an adjustable carrier 38 from which a doctor blade 40 depends. As the magnetic roller 24 rotates, it tends to agitate toner contained between the retaining plate 36 and the blade 40 with its carrier 38. The greatest turbulence is probably adjacent the outward edge of the doctor blade 40 where toner is about to be carried by the roller through a gap between the roller and the edge of this blade. Because the carrier 38 can be adjusted as will be described, this gap between the blade 40 and roller can be changed to control the height of toner carried by the roller towards the cylinder 14.

In the past, solid wall structures adjacent the doctor blade (or even part of it) have had toner impacted against them causing the toner to adhere or agglomerate into lumps of toner. This is especially true with toner requiring relatively low pressures for fusing (such as the toner used most advantageously with the present invention). By contrast, the carrier 38 of the present invention includes a block 42 to which the doctor blade 40 is attached by screws 44. The block 42 is relieved at its lower part to combine with the doctor blade 40 to define a recess 46. This elongate generally rectangular recess receives toner which tends to build up in the recess resulting in a "living" wall of toner indicated generally by a chain dotted line 48. This wall of toner has an entirely different property when compared with a wall of metal. Because it is made up of individual toner particles, it is first of all more resilient than metal and will continuously build and disintegrate as individual particles of toner remain on the wall and then leave the wall. Although the exact action is not fully understood at this time, it is believed that this resulting continuous movement of toner at the living wall tends to minimize agglomeration of toner because individual toner particles do not remain in contact with the wall to build up with others into lumps.

Structural details of the feeder system will now be described with reference to FIG. 3. Here it will be seen that the block 42 is elongate and has at its ends a pair of slotted openings 50, 52 which receive bolts 54 (one of which is shown). These bolts are used to adjustably attach the block to the formed support 39 which is shaped to receive the bolts 54 and has a surface 58 against which the block rests for angular location. The bolts 54 are associated with Belleville spring washers 60 and a common washer 62 so that although the block is held firmly against the surface 58, it can be moved along the surface by the use of adjusting screws 64 (one of which is seen) which pass through openings in the support 39 and engage in the block 42 in openings not seen in this view. Springs 66 are used to bias the block downwardly for combining with the screws to locate the block along the surface 58. The doctor blade 40 is attached to the underside of the block 42 by screws 69 so that adjustment of the block permits the doctor blade to be located accurately relative to the magnetic roller.

The retaining plate 36 is located and carried by bolts 70 (two of which are seen) which pass through a slotted lug 72 extending outwardly of the support, through a corresponding slot 74 in the plate 36, and then through a rigidifying piece 76 having openings for the bolts. Nuts 78 are then attached to the bolts and tightened after the plate has been positioned in relation to the roller as seen in FIG. 2.

The retaining plate 36 is formed with an inwardly extending lower portion 80 which is angled towards the doctor blade 40 in order to eliminate as much as possible any dead space where toner might accumulate and agglomerate. It has been found that this angular portion of the plate tends to minimize these possibilities and to direct the flow of toner towards the doctor blade and living wall 48.

Figure 3:
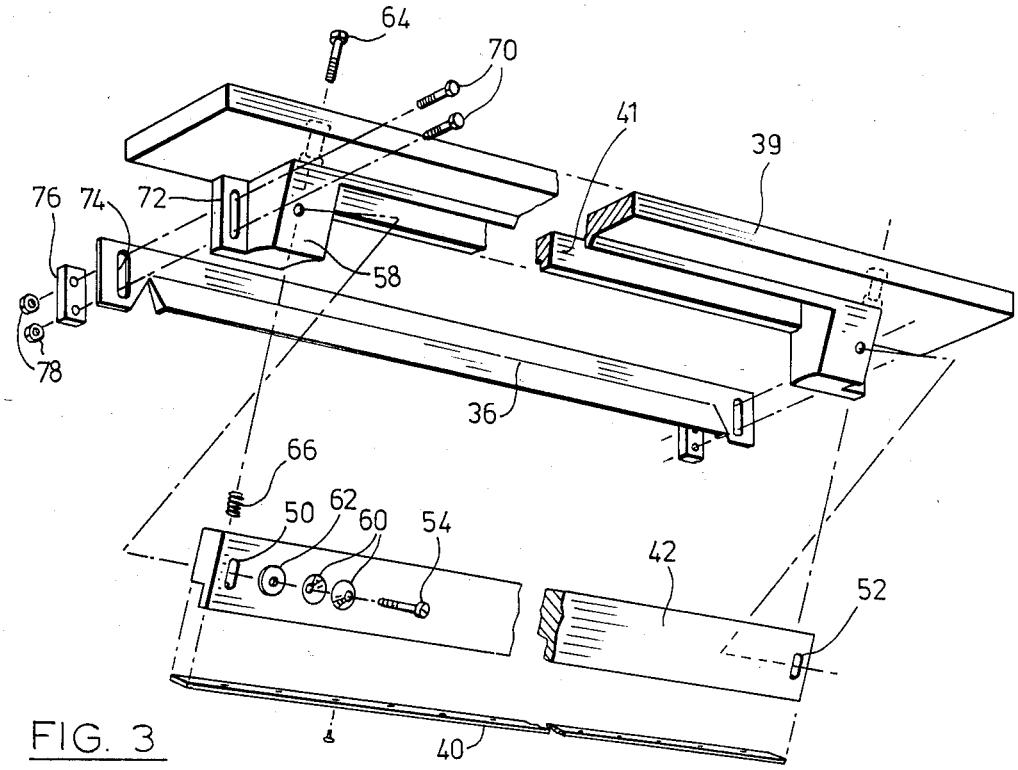
FIG. 3, which is not to the same scale as FIG. 2, is a perspective exploded view of parts forming the toner feeder system.

Although not shown in FIG. 3, a shield 80 (FIG. 2) is provided to prevent misaligned receptor sheets crashing into the magnetic roller as they pass from input rollers 82 (FIG. 1) to the nip between the cylinder 16 and roller 28. As seen in FIG. 2 the shield is attached to the block by screws 84 and located relative to the block by spacers 86.

A typical toner feeder system according to the invention was used with toner made by Synfax Mfg. of Newark, N.J., U.S.A. and sold under the identification number 5137-2. Referring to FIG. 2, the lower part of the plate 36 was inclined 30 degrees from vertical and terminated at a point 9.5 millimeters from the magnetic roller and spaced from a vertical plane containing the axis of the ro11er by 2.5 millimeters towards the doctor blade. These relationships minimised toner loss between the plate and the roller when the device was not in use.

The doctor blade is positioned to provide a desired depth of toner on the surface of the roller. Typically this is about 2 millimeters and the edge of the doctor blade is displaced from the aforesaid plane about 15 millimeters for a roller of 27 millimeters diameter.

It will be appreciated that the preferred embodiment can be varied within the scope of the invention. The doctor blade can for instance be made an integral part of the carrier block and the support can be varied depending upon how the structure fits into a particular copier or printer.

All such modifications are within the scope of the invention as defined by the attached claims.

We claim:

1. A toner feeder for supplying a controlled thickness of toner to a magnetic roller which carries the toner for toning a latent electrostatic image onto a dielectric or photoreceptor surface prior to transferring the toned image from this surface onto a receptor medium, the toner feeder comprising:

a support defining an opening for receiving toner under gravity;

an elongate retaining plate attached to the support and extending downwardly from the support and axially, the plate having an edge to be placed adjacent the roller to prevent flow of toner between the blade and the roller;

an elongate block adjustably coupled to the support and extending parallel to the retaining plate;

an elongate doctor blade attached to the block and lying axially and having an edge for placement adjacent the roller for forming with the roller a gap through which toner passes carried by the roller, the block having a support wall with a wall portion lying above the doctor blade, the doctor blade and the block combining to define an elongate recess immediately above the doctor blade, the support wall constituting reaction means so that in use toner flowing downwardly onto the roller between the plate and the block is carried by the roller towards the doctor blade and enters the recess and the reaction means causes toner to form a living wall in the recess, the living wall being of a limiting size, and the support wall in the recess being proportioned so that toner continuously attaches to the living wall and releases when the limiting size is reached, the limiting size of the living wall being sufficient to prevent toner agglomeration and build-up on the doctor blade.

2. Apparatus for toning latent electrostatic images on the surface of a rotating cylinder, the apparatus comprising:

a toner feeder as claimed in claim 1;

a magnetic roller positioned axially adjacent the retaining plate and said edge of the doctor blade; and means for rotating the magnetic roller to carry toner from the toner feeder to the surface of the rotating cylinder.

3. Apparatus for printing images onto a sheet receptor as the receptor passes through the apparatus, the apparatus comprising:

a cylinder having a layer defining an outer surface of the cylinder;

means for creating an electrostatic image on said surface as the cylinder rotates;

means for toning the electrostatic image comprising apparatus as claimed in claim 2, and a hopper attached to the support for supplying stored toner to the opening in the hopper and hence to the magnetic roller;

a pressure roller forming with the cylinder a nip for applying pressure to the receptor so that the toned image on the cylinder is transferred to the receptor; and means for driving the cylinder, pressure roller and magnetic roller.

4. A toner feeder as claimed in claim 1 in which said edge of the retaining plate on assembly is located relative to a vertical plane through the axis of the magnetic roller to the side of the plane containing the doctor blade.

5. A toner feeder as claimed in claim 1 in which the doctor blade is an integral part of the block.

* * * * *